US011136954B2

(12) United States Patent
Hosaka et al.

(10) Patent No.: US 11,136,954 B2
(45) Date of Patent: Oct. 5, 2021

(54) FUEL INJECTION VALVE

(71) Applicant: Hitachi Automotive Systems, Ltd., Hitachinaka (JP)

(72) Inventors: Tomoyuki Hosaka, Tokyo (JP); Eiji Ishii, Tokyo (JP); Kazuki Yoshimura, Tokyo (JP); Noriyuki Maekawa, Hitachinaka (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 0 days.

(21) Appl. No.: 16/754,824

(22) PCT Filed: Nov. 13, 2018

(86) PCT No.: PCT/JP2018/041907
§ 371 (c)(1),
(2) Date: Apr. 9, 2020

(87) PCT Pub. No.: WO2019/111643
PCT Pub. Date: Jun. 13, 2019

(65) Prior Publication Data

US 2021/0190025 A1 Jun. 24, 2021

(30) Foreign Application Priority Data

Dec. 8, 2017 (JP) ..... JP2017-235680

(51) Int. Cl.
*F02M 61/18* (2006.01)
*F02M 61/04* (2006.01)

(52) U.S. Cl.
CPC ..... *F02M 61/1813* (2013.01); *F02M 61/04* (2013.01)

(58) Field of Classification Search
CPC ..... F02M 61/1813; F02M 61/04
(Continued)

(56) References Cited

U.S. PATENT DOCUMENTS 6,883,491 B2 * 4/2005 Arndt ..... F02M 61/182 123/305
8,151,762 B2 * 4/2012 Nishimoto ..... F02B 23/104 123/298
(Continued)

FOREIGN PATENT DOCUMENTS

JP 2005-139989 A 6/2005
JP 2007-285205 A 11/2007
(Continued)

OTHER PUBLICATIONS

International Search Report with English translation and Written Opinion issued in corresponding application No. PCT/JP2018/041907 dated Jan. 29, 2019.

*Primary Examiner* — Hai H Huynh
(74) *Attorney, Agent, or Firm* — Foley & Lardner LLP

(57) ABSTRACT

A fuel injection valve is a fuel injection valve for injecting fuel to a combustion chamber of an internal combustion engine, which includes a valve body that is lifted by any one of a first lift amount of a maximum valve body lift amount and a second lift amount smaller than the first lift amount. In a case where the maximum valve body lift amount of the valve body is the first lift amount, a flow path area of a seat portion is larger than a sum of flow path areas of all injection holes, and in a case where the maximum valve body lift amount of the valve body is the second lift amount, the flow path area of the seat portion is smaller than the sum of flow path areas of all the injection holes.

9 Claims, 10 Drawing Sheets

(58) Field of Classification Search
USPC ..... 123/470, 298, 304, 305; 239/533.12
See application file for complete search history.

(56) References Cited

U.S. PATENT DOCUMENTS

| | | | | |
|---|---|---|---|---|
| 10,563,632 | B2 * | 2/2020 | Martin | F02M 43/04 |
| 2008/0196691 | A1 * | 8/2008 | Kihara | F02D 41/064 123/299 |
| 2016/0341165 | A1 * | 11/2016 | Ishikawa | F02M 61/1813 |
| 2019/0040790 | A1 | 2/2019 | Kusakabe | |

FOREIGN PATENT DOCUMENTS

| | | | |
|---|---|---|---|
| JP | 2008-045519 | A | 2/2008 |
| JP | 2010-101290 | A | 5/2010 |
| JP | 2010-180763 | A | 8/2010 |
| JP | 2013-068125 | A | 4/2013 |
| JP | 2016-061176 | A | 4/2016 |
| JP | 2017-008860 | A | 1/2017 |
| WO | WO-2017/145527 | A1 | 8/2017 |

* cited by examiner (a)

(b)

(a)

(b)

FUEL INJECTION VALVE

TECHNICAL FIELD

The present invention relates to a fuel injection valve used for an internal combustion engine such as a gasoline engine.

BACKGROUND ART

In recent years, there has been an increasing demand for gasoline engines in automobiles to improve fuel efficiency. As an engine with excellent fuel efficiency, in-cylinder injection engines have become widespread in which fuel is directly injected into a combustion chamber, and a mixture of injected fuel and intake air is ignited by an ignition plug and is exploded. The in-cylinder injection engines can freely set the fuel injection timing, so they can inject fuel during the intake stroke, and "homogeneous combustion," in which a highly homogeneous mixture is stirred by circulation and burned, and "stratified combustion," in which fuel is injected during the compression stroke to form a partially concentrated fuel mixture near the ignition plug and burned are used properly. Therefore, it is possible to select an optimal combustion according to operation conditions, which helps fuel economy.

In controlling the air-fuel mixture, it is essential to control the penetration force (penetration) that determines a fuel reaching distance and a flow rate of the injected fuel. For example, PTL 1 describes a technique capable of increasing the spray penetration force as the lift amount of a needle of the fuel injection valve increases and decreasing the spray penetration force as the needle lift amount decreases. However, the technique described in PTL 1 has a problem that the penetrations of all the injection holes change uniformly. In an engine, there is a demand to change the penetration only in a specific direction. Specifically, the required strength of the penetration force of the spray directed toward the piston greatly changes depending on the operation conditions. When injecting fuel during the intake stroke, the spray in the direction of the piston requires a strong penetration force to mix properly with the flow, but when injecting fuel late in the compression stroke, it is desirable that the penetration force be as small as possible in order to reduce the adhesion of the fuel to the piston because the positions of the fuel injection valve and the piston are close. On the other hand, it is desirable that the positions of the ignition plug and the fuel injection valve are fixed irrespective of operation conditions, and that the penetration force of spray directed to the ignition plug does not change significantly.

PTL 2 discloses a technique for selectively injecting from a group of injection holes having different diameters by providing a plurality of valve members for opening and closing each of the plurality of injection hole groups and an independent driving unit for each valve member. The technique described in PTL 2 can change the penetration and the flow rate depending on the injection direction, but has a problem that the structure is complicated.

CITATION LIST

Patent Literature

PTL 1: JP 2017-8860 A

PTL 2: JP 2016-61176 A

SUMMARY OF INVENTION

Technical Problem

For example, PTL 1 describes a technique capable of increasing the spray penetration force as the lift amount of a needle of the fuel injection valve increases and decreasing the spray penetration force as the needle lift amount decreases. However, the technique described in PTL 1 has a problem that the penetrations of all the injection holes change.

The invention has been made in view of the above problems, an object of the invention is to provide a fuel injection valve having a simple structure and capable of selectively controlling a penetration force of spray injected in a piston direction by a lift amount.

Solution to Problem

In order to solve the above problem, the fuel injection valve of the invention is a fuel injection valve for injecting fuel to a combustion chamber of an internal combustion engine, which includes a valve body that is lifted by any one of a first lift amount of a maximum valve body lift amount and a second lift amount smaller than the first lift amount. In a case where the maximum valve body lift amount of the valve body is the first lift amount, a flow path area of a seat portion is larger than a sum of flow path areas of all injection holes, and in a case where the maximum valve body lift amount of the valve body is the second lift amount, the flow path area of the seat portion is smaller than the sum of flow path areas of all the injection holes.

Advantageous Effects of Invention

According to the invention, with a simple structure, a penetration force of spray in a piston direction can be selectively controlled by a lift amount. The other configurations, operations, and effects of the invention will be described in detail in the following embodiments.

DESCRIPTION OF EMBODIMENTS

Hereinafter, embodiments according to the invention will be described.

First Embodiment

A control device for a fuel injection valve 119 according to a first embodiment of the invention will be described below with reference to FIGS. 1 and 2.

Figure 1:
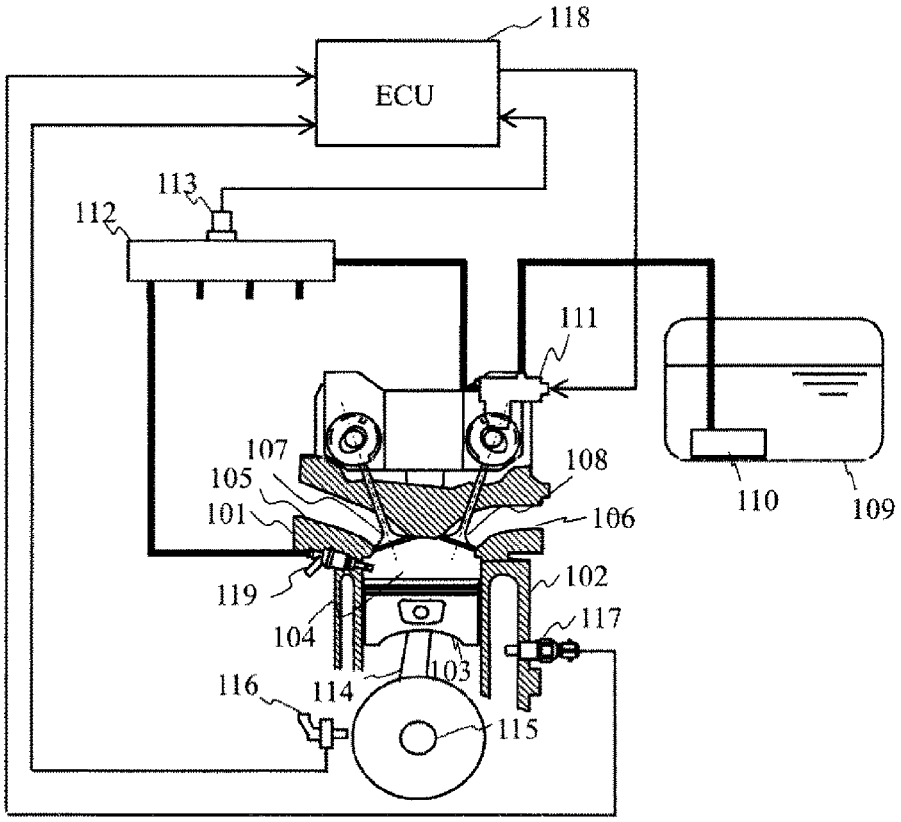
FIG. 1 is a diagram illustrating an outline of a configuration of an internal combustion engine according to a first embodiment of the invention.

FIG. 1 is a diagram illustrating an outline of a configuration of an in-cylinder injection engine. The basic operation of the in-cylinder injection engine will be described with reference to FIG. 1. In FIG. 1, a combustion chamber 104 is formed by a cylinder head 101, a cylinder block 102, and a piston 103 inserted into the cylinder block 102, and an intake pipe 105 and an exhaust pipe 106 are branched and connected to two toward the combustion chamber 104. An intake valve 107 is provided at an opening of the intake pipe 105, and an exhaust valve 108 is provided at an opening of the exhaust pipe 106, which operate so as to open and close by a cam operation method.

The piston 103 is connected to a crankshaft 115 via a connecting rod 114, and a crank angle sensor 116 can detect an engine speed. The value of the rotation speed is sent to an ECU (engine control unit) 118. A cell motor (not illustrated) is connected to the crankshaft 115. When the engine is started, the crankshaft 115 can be rotated by the cell motor when the engine starts. The cylinder block 102 is provided with a water temperature sensor 117, which can detect the temperature of engine cooling water (not illustrated). The temperature of the engine cooling water is sent to the ECU 118.

Although FIG. 1 describes only one cylinder, a collector (not illustrated) is provided upstream of the intake pipe 105 to distribute air to each cylinder. An air flow sensor and a throttle valve (not illustrated) are provided upstream of the collector, and the amount of air taken into the combustion chamber 104 can be adjusted by the opening of the throttle valve.

Fuel is stored in a fuel tank 109 and sent to a high-pressure fuel pump 111 by a feed pump 110. The feed pump 110 raises the pressure of the fuel to about 0.3 MPa and sends the fuel to the high-pressure fuel pump 111. The fuel pressurized by the high-pressure fuel pump 111 is sent to a common rail 112. The high-pressure fuel pump 111 pressurizes the fuel to about 30 MPa and sends the fuel to the common rail 112. A fuel pressure sensor 113 is provided on the common rail 112, and detects a fuel pressure. The value of the fuel pressure is sent to the ECU 118.

Figure 2:
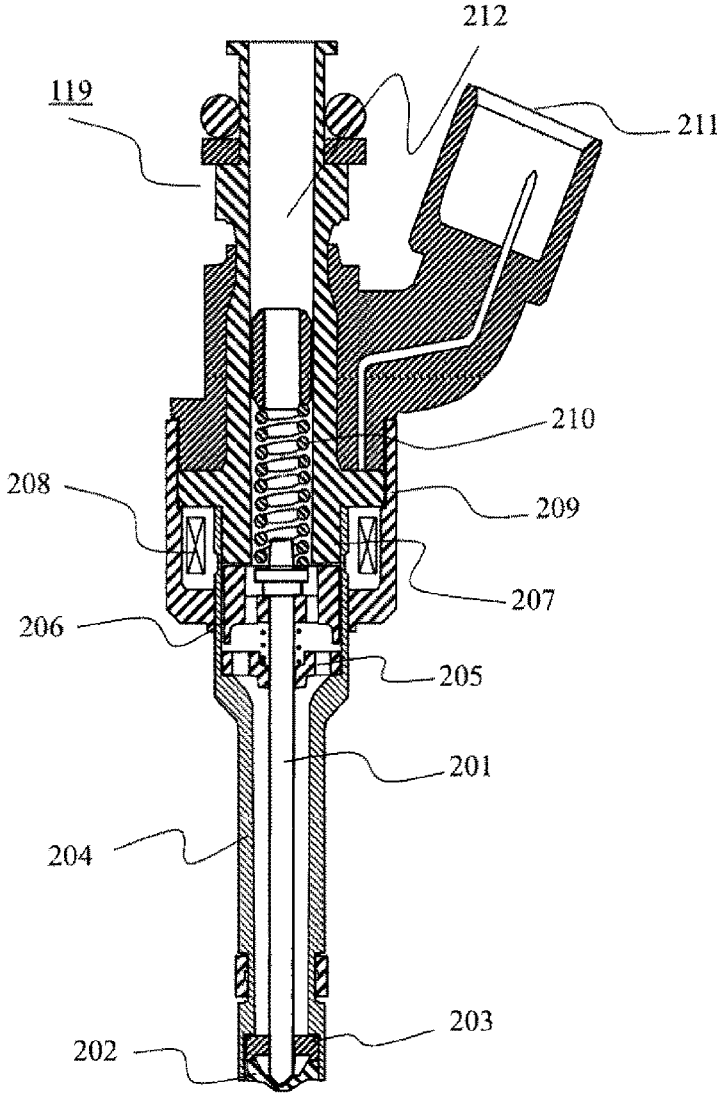
FIG. 2 is a diagram illustrating a fuel injection valve according to the first embodiment of the invention.

FIG. 2 is a diagram illustrating an example of an electromagnetic fuel injection valve as an example of the fuel injection valve 119 according to this embodiment. The basic operation of the injection device will be described with reference to FIG. 2. In FIG. 2, fuel is supplied from a fuel supply port 212 and supplied to the inside of the fuel injection valve 119. The electromagnetic fuel injection valve 119 illustrated in FIG. 2 is a normally-closed electromagnetic drive type, and when the coil 208 is not energized, a valve body 201 is urged by a spring 210, pressed against the seat member 202 bonded to the nozzle body 204 by welding. At this time, in the in-cylinder fuel injection valve 119, the supplied fuel pressure is in the range of approximately 1 MPa to 50 MPa.

When the coil 208 is energized through a connector 211, a magnetic flux density is generated in a core (fixed core) 207, a yoke 209, and an anchor 206 forming a magnetic circuit of an electromagnetic valve, and a magnetic attraction force is generated between the core 207 and the anchor 206 having a gap. When the magnetic attraction force is greater than the urging force of the spring 210 and the force due to the fuel pressure described above, the valve body 201 is attracted toward the core 207 by the anchor 206 while being guided by a guide member 203 and a valve body guide 205, and the valve is opened. When the valve is opened, a gap is generated between the seat member 202 and the valve body 201, and fuel injection is started. When the injection of fuel is started, the energy given as the fuel pressure is converted into kinetic energy, and the fuel is injected into an injection hole opened at the lower end portion of the fuel injection valve 119.

Figure 3:
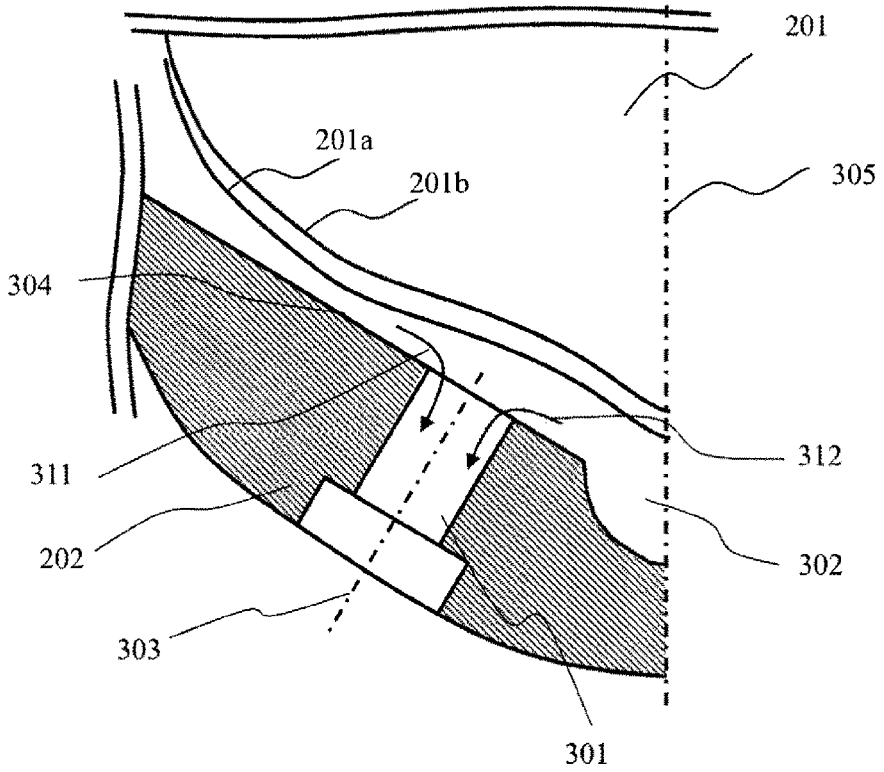
FIG. 3 is an enlarged cross-sectional view of a lower end portion of the fuel injection valve according to the first embodiment of the invention.

Next, the detailed shape of the valve body 201 will be described with reference to FIG. 3. FIG. 3 is an enlarged cross-sectional view of the lower end portion of the fuel injection valve 119, and includes the seat member 202, the valve body 201, and the like. The seat member 202 includes a valve seat surface 304 and a plurality of injection holes 301. The valve seat surface 304 and the valve body 201 extend axially symmetrically about a valve body central axis 305. When the lift amount is 0, the valve body 201 comes into line contact with the seat member 202 and the valve seat surface 304, and the flow of fuel is blocked. When the valve body 201 is set to a certain lift amount, the fuel is injected from the injection hole 301 through the gap between the seat member 202 and the valve body 201, along the path indicated by the arrow 311. Part of the fuel flows into the sack chamber 302 on the tip side from the injection hole, and flows into the injection hole from the path indicated by the arrow 312. The valve body can be set to a large lift amount and a small lift amount. The valve body position at the large lift amount is 201*b*, and the valve body position at the small lift amount is 201*a*. In addition, a valve opening pulse applied to the fuel injection valve 119 may be cut off before the valve is completely opened, so that the valve is closed before the lift amount becomes maximum. Also in this case, a plurality of maximum lift amounts can be set.

Next, a flow when the valve body 201 is located at a large lift position 201*b* will be described with reference to FIG. 4. At the time of the large lift, since a region is formed widely on the upstream side of the injection hole, the flow parallel to an injection hole axis 303 as indicated by the arrow 320 is strong, and the flow perpendicular to the injection hole axis 303 (cross flow) is weak. In addition, when the minimum cross-sectional area of the flow is set to be the injection hole, the flow is rapidly accelerated in the injection hole, and the flow parallel to the injection hole axis appears more strongly. Since the penetration force of spray is enhanced by increasing the axial speed in the injection hole, a spray having a strong penetration force is formed during a large lift. In addition, by setting the minimum cross-sectional area of the flow to be the sum of the cross-sectional areas of the injection holes, the flow is rapidly accelerated in the injection holes, and a spray having a strong penetration force is formed.

The flow when the valve body 201 is located at a small lift position 201*a* will be described with reference to FIG. 5. At the time of the small lift, the flow (cross flow) in the direction perpendicular to the injection hole axis 303 as indicated by the arrow 321 is increased because the flow path upstream of the injection hole is narrow. At this time, by setting the minimum cross-sectional area of the flow to be a seat portion A2, the flow is rapidly accelerated in the seat portion, and a cross flow perpendicular to the injection hole axis 303 appears strongly. As a result, the axial velocity in the injection hole is reduced, and a spray having a weak penetration force is formed.

As described above, in this embodiment, the fuel injection valve 119 that injects fuel into the combustion chamber of an internal combustion engine (preferably, an in-cylinder injection engine) includes the valve body 201 which is lifted such that the maximum valve body lift amount becomes any one of a first lift amount (large lift amount) and a second lift amount (small lift amount) smaller than the first lift amount (large lift amount). In a case where the maximum valve body lift amount of the valve body 201 becomes the first lift amount (large lift amount), the flow path area of the seat portion A2 is larger than the sum of the flow path areas of all the injection holes. In a case where the maximum valve body lift amount of the valve body 201 becomes the second lift amount (small lift amount), the flow path area of the seat portion A2 is smaller than the sum of the flow path areas of all the injection holes. Further, the seat portion A2 is a portion of the seat member 202 that makes linear contact when the valve body 201 is closed, and the flow path when the seat portion A2 is opened is formed on the circumference. In addition, the flow path area when the seat portion A2 is opened is defined by a minimum distance $L_{min} \times \pi$ between the seat portion A2 of the seat member 202 and the valve body 201. In addition, the flow path area of the injection hole 301 is defined by the minimum flow area of the injection hole 301.

In the fuel injection valve 119 of this embodiment, the distance between the seat position A2 and the valve body central axis 305 is located farther than the distance between an injection hole inlet center position A1 and the valve body central axis 305. In other words, the distance R1 between the injection hole inlet center position A1 and an intersection B1 of the valve body central axis 305 with a line perpendicular to the valve body central axis 305 from the injection hole inflow port A1 is set to be smaller than the distance R2 between the line perpendicular to the valve body central axis 305 and an intersection B2 of the valve body central axis 305 from the seat position A2.

Figure 6:
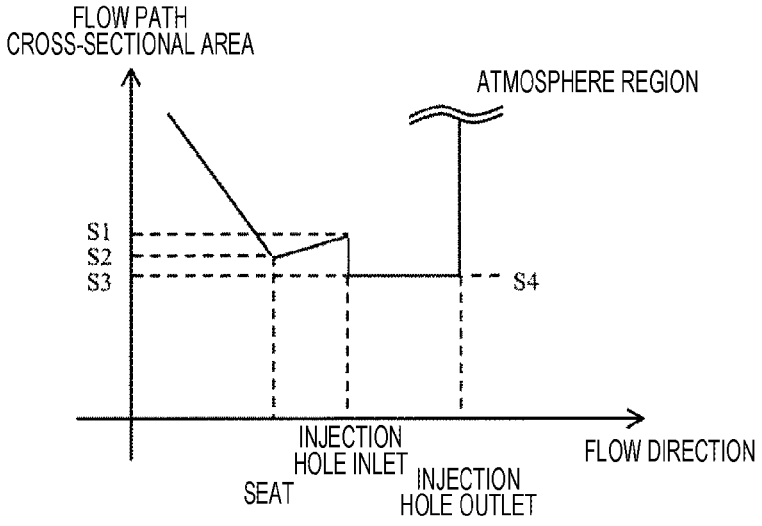
FIG. 6 is a diagram illustrating a flow path cross-sectional area in a flow direction according to the first embodiment of the invention.
Figure 6:
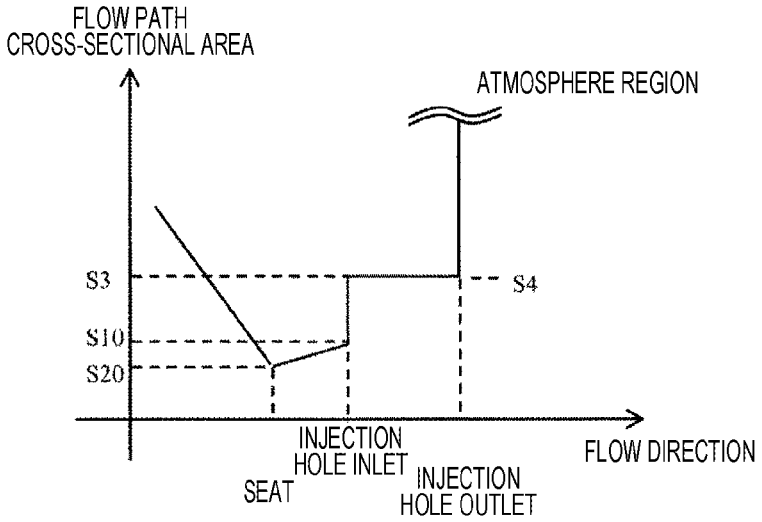

Next, the flow path cross-sectional area in the direction along the fuel flow will be described. FIG. 6(*a*) is a diagram illustrating a change in the flow direction of the flow path cross-sectional area during the large lift illustrated in FIG. 4. S1 indicates the flow path cross-sectional area immediately before the injection hole inlet, and S2 indicates the cross-sectional area of the flow at the seat position. S3 indicates the sum of the cross-sectional areas at the injection hole inlet, and S4 indicates the sum of the cross-sectional areas at the injection hole outlet. At the time of the large lift, the minimum cross-sectional area of the flow path in the flow direction may be set to be the sectional area S3 at the injection hole inlet. By setting the minimum cross-sectional area of the flow to be the cross-sectional area of the injection hole, the flow is rapidly accelerated in the injection hole, and a spray having a strong penetration force is formed.

Further, the relation between the flow path cross-sectional area S2 at the seat position and the flow path cross-sectional area S1 immediately before the injection hole inlet may be either S1<S2 or S1>S2. In addition, the relation between the cross-sectional area S3 of the injection hole inlet and the cross-sectional area S4 of the injection hole outlet may be S3>S4 or S3<S4.

Figure 5:
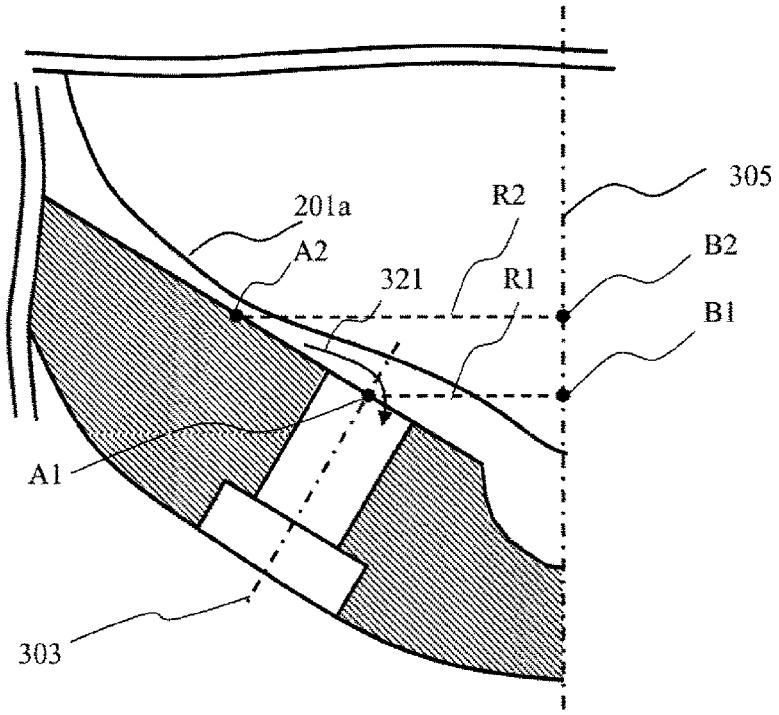
FIG. 5 is an enlarged cross-sectional view of the lower end portion of the fuel injection valve at the time of a low lift according to the first embodiment of the invention.

FIG. 6(*b*) illustrates a change in the flow direction of the flow path cross-sectional area during the small lift illustrated in FIG. 5. At the time of the small lift, the minimum cross-sectional area of the flow path in the flow direction is set to be the flow path cross-sectional area S20 at the seat position. At this time, the flow is accelerated in the seat portion, and gradually decelerates with an increase in the downstream cross-sectional area. That is, by setting S20<S10, the flow downstream of the seat portion is gradually decelerated. At the time of the small lift, when the injection hole inlet cross-sectional area S3 is set to be S10<S3 with respect to the flow cross-sectional area S10 immediately before the injection hole inlet, a cross flow occurs near the injection hole inlet, and an effect of weakening the penetration force can be obtained. The ratio between S10 and S3 may be set, for example, to 1:2.

As described above, the fuel injection valve 119 of this embodiment is configured such that, in a case where the maximum valve body lift amount of the valve body 201 becomes the first lift amount (large lift amount), the sum of the flow path areas of all the injection holes becomes the minimum cross-sectional area of the flow path, and in a case where the maximum valve body lift amount of the valve body 201 becomes the second lift amount (small lift amount), the flow path area of the seat portion 2A becomes the minimum cross sectional area of the flow path.

Figure 7:
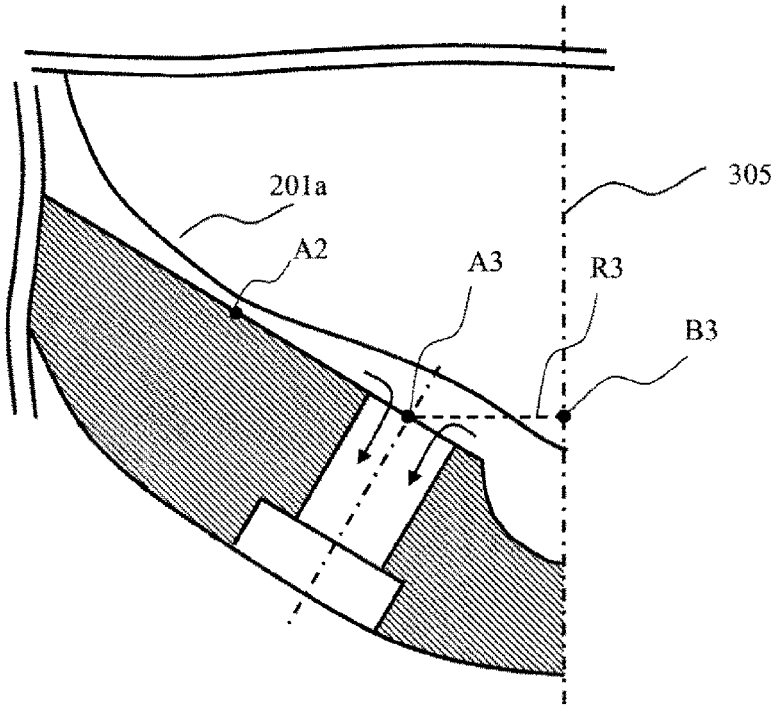
FIG. 7 is an enlarged cross-sectional view of the lower end portion of the fuel injection valve at the time of a low lift according to the first embodiment of the invention.

Next, a flow field in a case where the injection hole is located near the center of the valve body during the small lift will be described with reference to FIG. 7. FIG. 7 illustrates a cross section similar to FIG. 5, in which only the injection hole position is located closer to the valve body central axis 305. The flow speed of the flow accelerated by the seat portion A2 gradually decreases due to the spread of the cross-sectional area in the flow direction. When the flow is sufficiently decelerated from the seat portion to the injection hole, no cross flow occurs at the injection hole inlet, and only an injection hole axis direction speed appears. Since a cross flow does not occur even during the large lift (not illustrated), sensitivity to penetration due to the lift amount is reduced. That is, assuming that the center of the injection hole is A3, and that an intersection of the perpendicular line from the center of the injection hole to the valve body central axis 305 and the valve body central axis 305 is B3, the length R3 of the line segment connecting A3 and B3 is set to be smaller than R1 illustrated in FIG. 5, so that the sensitivity to penetration due to the lift amount can be reduced.

Figure 8:
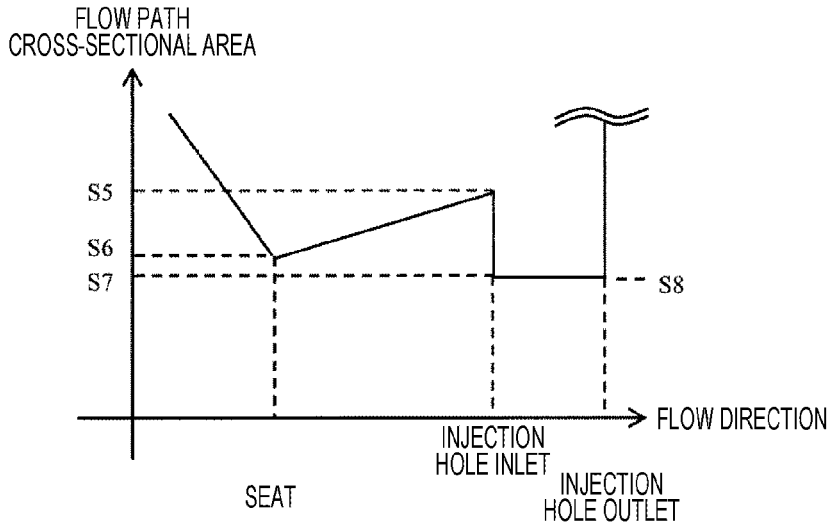
FIG. 8 is a diagram illustrating a flow path cross-sectional area in the flow direction according to the first embodiment of the invention.
Figure 8:
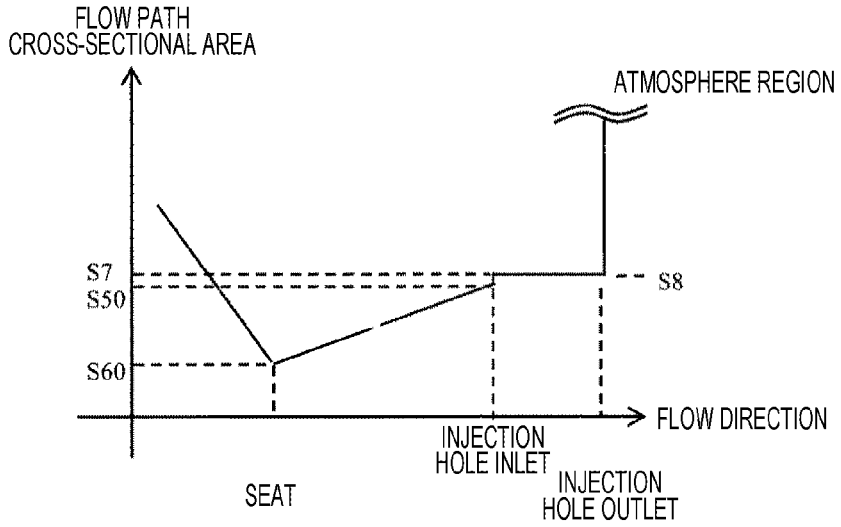

The flow path cross-sectional area in the direction along the fuel flow will be described with reference to FIG. 8. FIG. 8(*a*) illustrates a change in the flow path cross-sectional area in the flow direction, in a case where the large lift is set, at the injection hole position in FIG. 7 S5 indicates the flow path cross-sectional area immediately before the injection hole inlet, and S6 indicates the cross-sectional area of the flow at the seat position. S7 indicates the sum of the cross-sectional areas at the injection hole inlet, and S8 indicates the sum of the cross-sectional areas at the injection hole outlet. In the injection hole of FIG. 7, the distance between the seat position and the injection hole inlet is larger than that of FIG. 5, so the position of the horizontal axis of the injection hole inlet illustrated in FIG. 8(*a*) is illustrated downstream from the position of the horizontal axis of the injection hole inlet illustrated in FIG. 6(*a*). By setting the minimum cross-sectional area of the flow in the flow direction to be the injection hole inlet at the time of the large lift, the flow is rapidly accelerated in the injection hole, and a cross flow is unlikely to occur.

FIG. 8(*b*) illustrates the flow path cross-sectional area in the small lift state at the injection hole position illustrated in FIG. 7. As in FIG. 6(*b*), at the time of the small lift, the minimum cross-sectional area in the flow direction is set to be the flow path cross-sectional area S60 at the seat position. In this embodiment, the cross-sectional area gradually increases in accordance with the flow downstream of the seat portion, and the ratio of the cross-sectional areas S7 and S50 in the injection hole inlet may be, for example, 10:9. In other words, the flow is sufficiently decelerated before the flow reaches the injection hole inlet, so that the speed of the flow does not suddenly change, and the cross flow hardly occurs. In addition, by setting S7 and S50 to be close values, abrupt deceleration of the speed does not occur in the process of flowing to the injection hole inlet, so that the cross flow can be suppressed.

That is, by arranging the center of the injection hole close to the valve body central axis, the sensitivity of the cross flow generation due to the lift amount is reduced, and the change in penetration hardly occurs. Further, the relation between the cross-sectional areas may be set to be S7<S50. Even in the case of S7<S50, the cross flow is less likely to occur, and the change in penetration due to the lift amount is less likely to occur.

Figure 9:
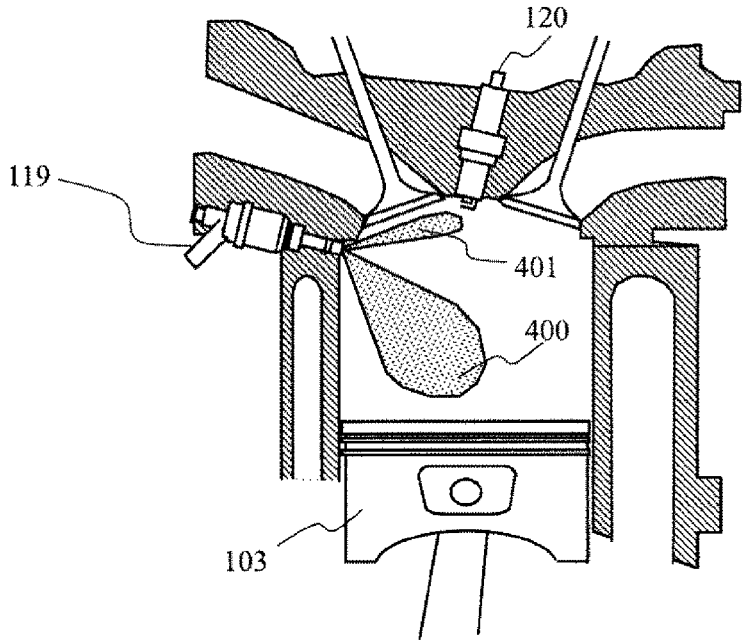
FIG. 9 is a diagram illustrating a spray direction of the internal combustion engine according to the first embodiment of the invention.
Figure 10:
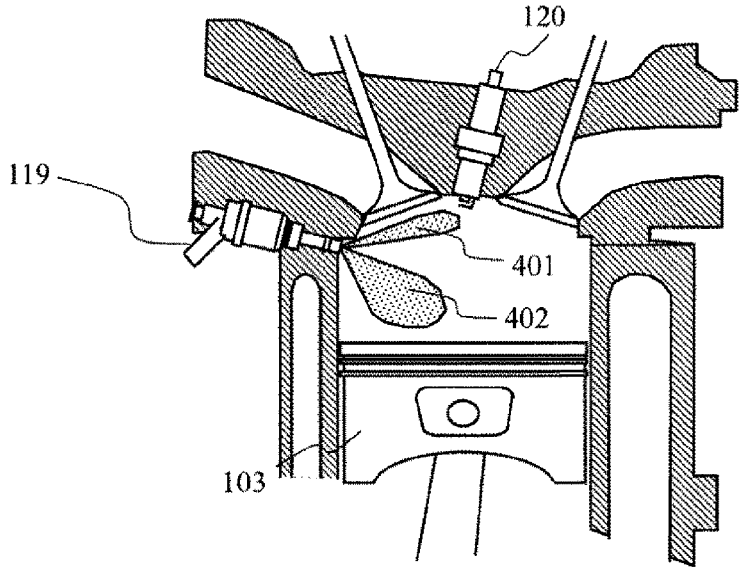
FIG. 10 is a diagram illustrating the spray direction of the internal combustion engine according to the first embodiment of the invention.

Next, FIGS. 9 and 10 illustrate schematic views of fuel injection into the combustion chamber. In this embodiment, part of the spray injected from the fuel injection valve 119 forms a spray 400 directed in the direction of the piston 103, and part forms a spray 401 directed in the direction of a plug 120. At this time, since a relative position between the fuel injection valve 119 and the ignition plug 120 is constant regardless of the operating conditions, it is desirable that the penetration of the spray 401 is constant regardless of the operating conditions. On the other hand, the spray 400 is directed in the direction of the piston, and the relation between the fuel injection valve 119 and the piston 103 at the fuel injection timing greatly differs depending on an injection start time. For example, in a case where the fuel is injected in the latter half of the compression stroke, the relative distance between the fuel injection valve 119 and the piston 103 becomes shorter, so that it is desirable that the penetration of the spray directed in the piston direction is weak as illustrated by the spray 402 in FIG. 10. In addition, in a case where the fuel is evenly diffused in the cylinder while overcoming the air flow in the combustion chamber, a strong penetration is required. On the other hand, a weak penetration is desired to reduce the adhesion of the fuel to the wall at startup.

Figure 11:
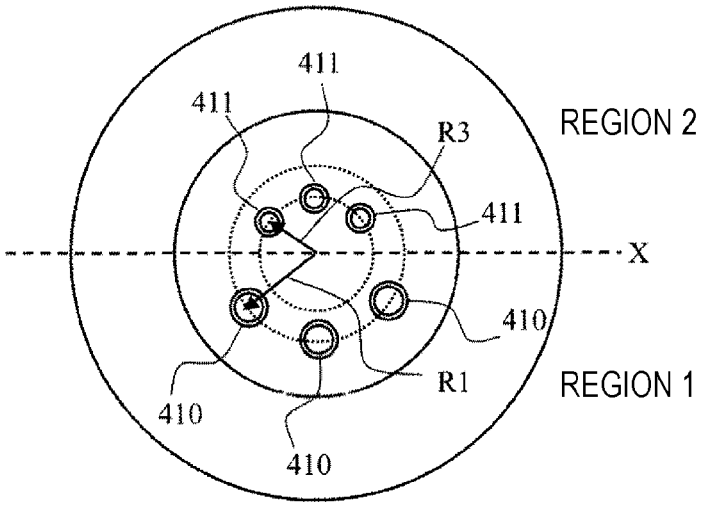
FIG. 11 is a diagram illustrating an arrangement of injection holes of the fuel injection valve according to the first embodiment of the invention.
Figure 12:
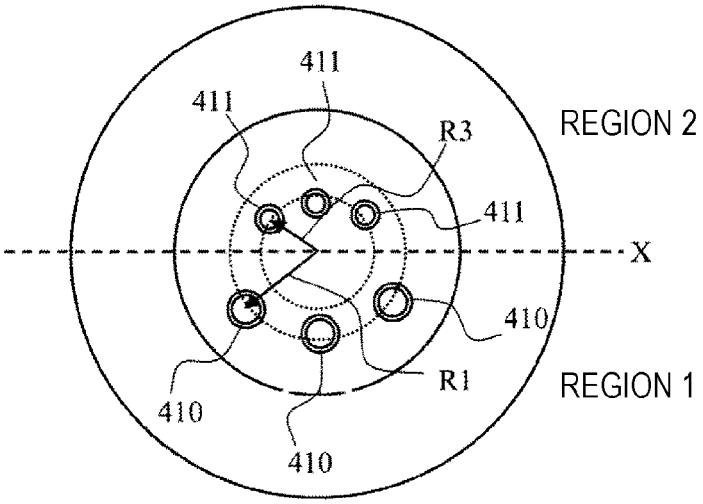
FIG. 12 is a diagram illustrating an arrangement of injection holes of the fuel injection valve according to the first embodiment of the invention.

FIGS. 11 and 12 illustrate the circumferential arrangement of the injection hole inlet when viewed from the upstream side in the fuel injection valve 119 of this embodiment. In this embodiment, the injection hole group 410 where the center of the injection holes is located on a radius R1 is called a first injection hole group, and the injection hole group 411 where the center of the injection holes is located on a radius R3 is called a second injection hole group. That is, the spray injected from the injection hole group 410 is directed to the piston 103, and the spray injected from the injection hole group 411 is directed to the ignition plug 120. However, the configuration is as illustrated in FIG. 12. The center position of each injection hole inlet does not necessarily have to completely match the radius R1 or the radius R3, and may be arranged so as to be slightly shifted.

However, it is assumed that the relation of R1>R3 is established. In addition, in this embodiment, the centers of the injection holes of the first injection hole group (injection hole group 410) are formed near the seat portion A2 where the valve body 202 seated with respect to the centers of the injection holes of the second injection hole group (injection hole group 411).

That is, the fuel injection valve 119 of this embodiment has the first injection hole group (injection hole group 410) directed in the direction of the piston 103 and the second injection hole group (injection hole group 411) directed in the direction of the ignition plug 120 compared to the first injection hole group (injection hole group 410). The injection hole pitch radius R1 at which the center of the injection holes of the first injection hole group (injection hole group 410) is located is configured to be larger than the injection hole pitch radius R3 at which the center of the injection holes of the second injection hole group (injection hole group 411) is located.

Figure 4:
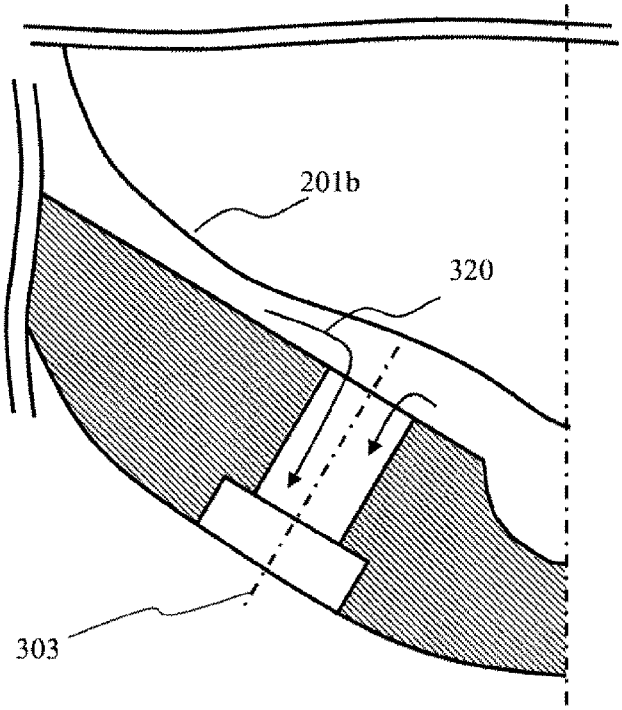
FIG. 4 is an enlarged cross-sectional view of the lower end portion of the fuel injection valve at the time of a high lift according to the first embodiment of the invention.

As illustrated in FIGS. 4 and 5, in the first injection hole group (the injection hole group 410) in which the center of the injection holes is located on the radius R1, the strength of the cross flow changes according to the lift amount, and the penetration changes. That is, by setting the first injection hole group (the injection hole group 410) to be directed to direct the piston 103, the penetration of the spray in the direction of the piston 103 can be controlled according to the operating conditions. However, it is not necessary that all the injection holes of the first injection hole group (injection hole group 410) are directed in the direction of the piston 103, and some injection holes among the injection hole groups belonging to the first injection hole group (injection hole group 410) may be directed in the direction of the piston 103.

As illustrated in FIG. 7, the second injection hole group (injection hole group 411), in which the center of the injection holes is located on the radius R3, has a low sensitivity to penetration due to the lift amount. That is, by setting the second injection hole group (injection hole group 411) to be directed to the ignition plug 120, the penetration in the direction of the ignition plug 120 can be kept constant depending on the operating conditions. However, it is not necessary that all the injection holes of the second injection hole group (the injection hole group 411) are directed in the ignition plug direction, and some injection holes among the injection hole groups belonging to the second injection hole group (the injection hole group 411) may be directed in the direction of the ignition plug 120.

According to this embodiment, the difference between the penetration of the spray between the large lift and the small lift is configured to be larger in the first injection hole group (injection hole group 410) than in the second injection hole group (injection hole group 411). With this configuration, it becomes possible to selectively control the penetration in the piston direction by the lift amount.

As described above, the first injection hole group (injection hole group 410) and the second injection hole group (injection hole group 411) that are directed in the plug direction are provided, and the injection hole pitch radius R1 where the center of the injection holes of the first injection hole group (injection hole group 410) is located is configured to be larger than the injection hole pitch radius R3 of the injection hole at which the center of the injection holes of the second injection hole group (injection hole group 411) is located. Thus, the penetration in the piston direction can be selectively controlled by the lift amount.

In addition, by controlling the lift amount in the intake stroke injection to be larger than the lift amount in the compression stroke injection, the uniformity of the air-fuel mixture in the intake stroke can be increased while appropriately reducing the adhesion to the piston in the compression stroke. That is, in the case of the intake stroke injection, the valve body 201 is lifted such that the maximum valve body lift amount becomes the first lift amount (large lift amount), and in the case of the compression stroke injection, the valve body is lifted by the second lift amount (small lift amount) which is smaller than the first lift amount (large lift amount).

In this embodiment, as illustrated in FIG. 11, the injection hole group 410 of the first injection hole group is continuously arranged in the circumferential direction, and the injection hole group 410 of the second injection hole group is continuously arranged in the circumferential direction. In addition, as illustrated in FIG. 11, on a cross section orthogonal to the axis direction of the valve body, all the injection holes of the first injection hole group (injection hole group 410) are located in one region 1 with respect to a straight line X passing through the center. All the injection holes of the second injection hole group (injection hole group 411) are arranged to be located in a region 2 opposite to the one region 1 with respect to the straight line X. With this setting, the flow into the injection holes can be made symmetrical, and the dispersion of the spray can be suppressed.

Figure 14:
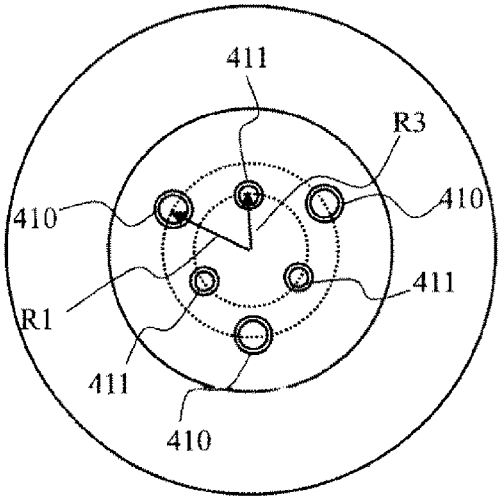
FIG. 14 is a diagram illustrating an arrangement of injection holes of the fuel injection valve according to the first embodiment of the invention.

However, as illustrated in FIG. 14, the injection holes of the first injection hole group (injection hole group 410) and the injection holes of the second injection hole group (injection hole group 411) may be alternately arranged in the circumferential direction. By adjusting the inclination of the injection holes so as to face in the specified direction, the spray injection direction can be directed to the direction of the piston 103 and the direction of the ignition plug 120, respectively. In addition, by disposing the holes alternately, the distance between the sprays can be increased, and interference between the sprays can be reduced.

Figure 13:
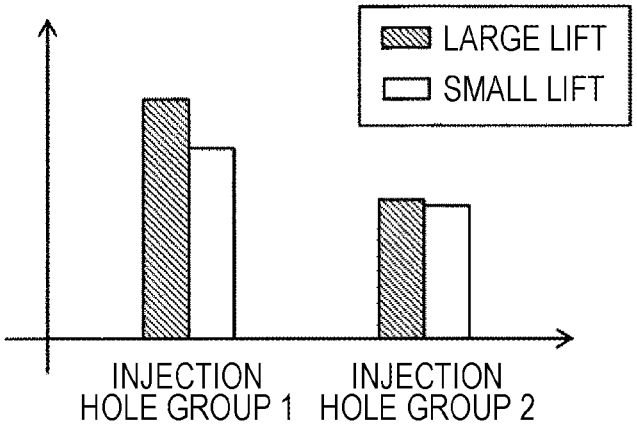
FIG. 13 is a diagram illustrating a change in a flow rate according to a lift amount of the fuel injection valve according to the first embodiment of the invention.

Next, a change in the flow rate due to the lift amount will be described with reference to FIGS. 11 and 13. In this embodiment, the cross-sectional area of the injection holes of the first injection hole group (injection hole group 410) is set to be larger than the cross-sectional area of the injection holes of the second injection hole group (injection hole group 411). In addition, in FIGS. 11 and 12, the cross-sectional areas of the injection holes in the first injection hole group (injection hole group 410) and the second injection hole group (injection hole group 411) are the same. When the areas are different, the cross-sectional area of the injection holes is circular, and the injection hole diameter of the smallest injection hole among the injection holes of the first injection hole group (injection hole group 410) is desirably configured to be larger than the largest injection hole diameter among the injection holes of the second injection hole group (injection hole group 411). In addition, it is desirable that all the injection holes of the first injection hole group (injection hole group 410) have the same injection hole diameter. When the lift amount is large, the minimum cross-sectional area of the flow path is the sum of the cross-sectional areas of the injection holes, so that the ratio of the cross-sectional areas of the injection holes becomes the ratio of the flow rate. That is, the injection hole cross-sectional area of the first injection hole group (injection hole group 410) to be directed to the piston 103 is set to be larger than the injection hole cross-sectional area of the second injection hole group (injection hole group 411) to be directed to the ignition plug 120, so that the flow rate of the spray in the direction of the piston can be increased.

On the other hand, when the lift amount is small, the amount of fuel flowing into the injection holes decreases in the first injection hole group (the injection hole group 410) due to the influence of the cross flow. That is, as illustrated in FIG. 13, the flow rate of the first injection hole group (injection hole group 410) is significantly reduced when the lift amount is small as compared with the state where the lift amount is large. In the second injection hole group (injection hole group 411), the flow rate of the fuel does not greatly change depending on the lift amount because the sensitivity of the fuel flowing into the injection holes by the lift amount is low.

That is, the injection hole cross-sectional area of the first injection hole group (injection hole group 410) to be directed to the piston is set to be larger than the injection hole cross-sectional area of the second injection hole group (injection hole group 411) to be directed to the ignition plug, so that the flow rate of the spray only in the piston direction can be controlled by the lift amount.

Thus, the variation in the flow rate of the spray directed to the ignition plug is reduced, and the stability of ignition can be improved.

In addition, the injection hole axis (303 in FIG. 5) of the injection hole of the first injection hole group (injection hole group 410) is may be set to have a larger angle with the valve body central axis (305 of FIG. 5) compared to the injection hole axis (303 in FIG. 5) of the injection hole of the second injection hole group (injection hole group 411). With this configuration, the separation of the first injection hole group at the time of the small lift can be promoted, and the sensitivity to the lift amount can be further increased.

In addition, the cross-sectional area of all the injection holes in each injection hole group does not need to be constant, and a maximum injection hole cross-sectional area of the injection holes belonging to the first injection hole group may be set to be larger than a minimum injection hole cross-sectional area of the injection holes belonging to the second injection hole group. This makes it possible to finely set the spray for each ejection direction.

Further, in this embodiment, the cross-sectional area of the injection hole is circular, and the injection hole diameter of the smallest injection hole among the injection holes of the first injection hole group is set to be larger than the injection hole diameter of the largest injection hole among the injection holes of the second injection hole group, so that a desired effect can be obtained.

However, a cross-sectional shape of each injection hole does not necessarily have to be circular, and may be, for example, a tapered shape or an elliptical shape.

REFERENCE SIGNS LIST

101 cylinder head
102 cylinder block
103 piston

104 combustion chamber
105 intake pipe
106 exhaust pipe
107 intake valve
108 exhaust valve
109 fuel tank
110 feed pump
111 high-pressure fuel pump
112 common rail
113 fuel pressure sensor
114 connecting rod
115 crankshaft
116 crank angle sensor
117 water temperature sensor
118 ECU
119 fuel injection valve
120 ignition plug
201 valve body
201*a* valve body position in low lift state
201*b* valve body position in high lift state
202 seat member
203 guide member
204 nozzle body
205 valve body guide
206 anchor
207 core
208 coil
209 yoke
210 spring
211 connector
212 fuel supply port
301 injection hole
302 sack chamber
303 center axis of injection hole
304 valve seat surface
305 valve body central axis
311 inflow from seat portion
312 inflow from sack chamber
320 inflow during high lift
321 inflow during low lift (cross flow)
400 high penetration spray directed to piston
401 spray directed to ignition plug
402 low penetration spray directed to piston
410 injection holes belonging to first injection hole group
411 injection holes belonging to second injection hole group

The invention claimed is:

1. A fuel injection valve for injecting fuel into a combustion chamber of an internal combustion engine, comprising:

a first injection hole group directed to a piston, the first injection hole group including a plurality of first injection holes; and a second injection hole group directed to an ignition plug compared to the first injection hole group, the second injection hole group including a plurality of second injection holes, wherein an injection hole pitch radius where a center of all of the plurality of first injection holes of the first injection hole group is located is larger than an injection hole pitch radius where a center of all of the plurality of second injection holes of the second injection hole group is located, wherein an injection hole cross-sectional area of each of the plurality of first injection holes belonging to the first injection hole group is larger than an injection hole cross-sectional area of each of the plurality of the second injection holes belonging to the second injection hole group, and wherein all of the plurality of first injection holes of the first injection hole group are located in one region with respect to a straight line passing through a center on a cross section orthogonal to an axis direction of the valve body, and all of the plurality of second injection holes of the second injection hole group are located in a region opposite to the one region with respect to the straight line.

2. The fuel injection valve according to claim 1, further comprising:

a valve body that is lifted such that a maximum valve body lift amount becomes any one of a first lift amount or a second lift amount smaller than the first lift amount, wherein, when the maximum valve body lift amount of the valve body becomes the first lift amount, a sum of flow path areas of all injection holes becomes a minimum cross-sectional area of a flow path, and when the maximum valve body lift amount of the valve body becomes the second lift amount, a flow path area of a seat portion becomes the minimum cross-sectional area of the flow path.

3. The fuel injection valve according to claim 1, wherein a cross-sectional area of each of the injection holes is circular.

4. The fuel injection valve according to claim 1, wherein the plurality of first injection holes of the first injection hole group are arranged continuously in a circumferential direction, and the plurality of second injection holes of the second injection hole group are arranged continuously in a circumferential direction.

5. The fuel injection valve according to claim 1, wherein an injection hole axis of the plurality of first injection holes of the first injection hole group forms a larger angle with a valve body central axis compared to an injection hole axis of the plurality of second injection holes of the second injection hole group.

6. The fuel injection valve according to claim 1, wherein a lift amount in an intake stroke injection is controlled to be larger than a lift amount in a compression stroke injection.

7. The fuel injection valve according to claim 1, wherein the center of the plurality of first injection holes of the first injection hole group is closer to a seat portion on which the valve body is seated than a center of the plurality of second injection holes of the second injection hole group.

8. The fuel injection valve according to claim 1, wherein a difference in penetration of spray between a large lift and a small lift is larger in the first injection hole group than in the second injection hole group.

9. The fuel injection valve according to claim 1, wherein a lift amount in an intake stroke injection is controlled to be larger than a lift amount in a compression stroke injection.

* * * * *